US007047709B2

(12) United States Patent
Hamilton

(10) Patent No.: US 7,047,709 B2
(45) Date of Patent: May 23, 2006

(54) STRAW-FILLING DEVICE

(76) Inventor: Kathryn M. Hamilton, 140 Langford Rd., Raymond, NH (US) 03077

( * ) Notice: Subject to any disclaimer, the term of this patent is extended or adjusted under 35 U.S.C. 154(b) by 0 days.

(21) Appl. No.: 10/636,089

(22) Filed: Aug. 7, 2003

(65) Prior Publication Data

US 2004/0025475 A1 Feb. 12, 2004

Related U.S. Application Data

(60) Provisional application No. 60/402,159, filed on Aug. 8, 2002.

(51) Int. Cl.
*B65B 1/04* (2006.01)

(52) U.S. Cl. ..... 53/469; 53/477; 53/479; 53/371.8; 53/372.6; 53/374.8; 53/250; 53/284

(58) Field of Classification Search ..... 53/469, 53/477, 479, 481, 371.8, 372.6, 374.8, 376, 53/250, 284, 284.5, 284.7, 467, 267, 270, 53/375.9; 221/165, 172, 176, 184
See application file for complete search history.

(56) References Cited

U.S. PATENT DOCUMENTS 3,019,575 A * 2/1962 Charley et al. ..... 53/505
3,382,644 A 5/1968 Vogt
3,452,505 A 7/1969 Hoag
3,631,903 A 1/1972 Huggins
3,683,977 A * 8/1972 Crowe et al. ..... 141/130
3,687,175 A 8/1972 Babey
3,842,569 A * 10/1974 McClelland et al. ..... 53/469
3,880,210 A * 4/1975 Randolph et al. ..... 141/175
3,923,084 A 12/1975 Matthews et al.
3,968,901 A * 7/1976 Peva, Jr. ..... 221/93

(Continued)

*Primary Examiner*—Stephen F. Gerrity
*Assistant Examiner*—Hemant M. Desai
(74) *Attorney, Agent, or Firm*—Norma E. Henderson

(57) ABSTRACT

An automated, fully programmable, and adaptable device fills straws or straw-like packages with any type of flowing, or flowable, liquid. A straw is dropped from a hopper down chutes into a capture area where it is held and filled with liquid, after which it is sealed. The straw dropping, capture, filling, and sealing actions are preferably automatically controlled by a preprogrammed electronic controller. The major elements of a typical embodiment of the invention include means for dropping a straw or other receptacle into a fixed mounting position consistently, optional means for heating fluids throughout the fill process, means for filling the receptacle, and means for sealing the receptacle. The straw hopper has a retractable slide plate at its base that slides back to allow only one straw at a time to fall through the chutes into the capture area. In the preferred embodiment, the slide plate at the bottom of the hopper moves back and forth in a predefined fully programmable sequence. In one embodiment, when the straw comes to rest in the capture area, it is pinched and sealed at the bottom in preparation for filling. A filling nozzle moves into a predefined position over the straw to be filled and the straw is filled with a preset amount of liquid. After filling, the top of the straw is pinched and then sealed, completing packaging of the liquid. Preferably, the sequence of actions may be easily adapted or changed by reprogramming the automatic controller. After sealing, the straw is dropped into the collection area. Preferably, steps are monitored by one or more sensor monitors, preferably with one sensor monitoring each of the three phases of operation.

32 Claims, 8 Drawing Sheets

U.S. PATENT DOCUMENTS 3,974,623 A 8/1976 Bate
4,021,283 A 5/1977 Weikert
4,340,096 A 7/1982 Stoddard
4,411,295 A 10/1983 Nutter
4,491,159 A * 1/1985 Colacci ..... 141/134
4,537,230 A 8/1985 Schindel
4,557,103 A 12/1985 Scwartz et al.
4,614,073 A * 9/1986 Argazzi ..... 53/54
4,684,040 A 8/1987 Jonovic et al.
4,804,022 A * 2/1989 Berger ..... 141/164
4,939,884 A 7/1990 Peters
5,501,367 A * 3/1996 Chigira ..... 222/55
5,743,430 A * 4/1998 Freixas ..... 221/97
6,062,277 A * 5/2000 Seo ..... 141/362
6,725,889 B1 * 4/2004 Perez Vales ..... 141/104
6,732,486 B1 * 5/2004 Saint-Ramon et al. ..... 53/131.4
6,739,111 B1 * 5/2004 Banks et al. ..... 53/415

* cited by examiner

STRAW-FILLING DEVICE

This application claims priority to U.S. Provisional Application Ser. No. 60/402,159, filed Aug. 8, 2002.

FIELD OF THE INVENTION

This invention relates to packaging devices and, in particular, to devices for filling straw-like receptacles with liquids.

BACKGROUND

A large number of devices for filling straws and other straw-like or pillow-type packages with liquids are known in the art. However, these devices generally share one or more disadvantages, including large size, lack of portability, high complexity, high cost and/or lack of commercial availability, lack of adaptability to different types and sizes of products, and/or an inability to process small batches efficiently. Many of these disadvantages are particularly apparent when the devices are needed in a retail-type setting for producing only a small quantity of filled straws at one time, such as is often encountered in small farm-based or single store-type businesses. A good example of such an application is the production of "honey straws"—small straw or pillow-type packages filled with honey that are often sold by individual beekeepers either directly to customers or through local farm stands.

An example of a prior art device for producing honey-filled straws is disclosed in U.S. Pat. No. 4,939,884 (Peters, 1990). This patent discloses an apparatus for filling receptacles with honey comprising heating means and pumping means to force the honey in a circular shaped filler with a plurality of feed tubes arranged like spokes on a wheel. A conveyor nestles the receptacles between clogs of the conveyor. As each feed tube is inserted in the receptacle, the receptacle is filled. Additionally, the receptacle, which is moving on the conveyor, causes the filler to rotate so that each successive receptacle is filled by the next feed tube. A bottom sealer and a top sealer gradually squeeze the ends of the receptacle until they are cut and sealed by a current carrying wire.

The Peters apparatus has many of the disadvantages listed above. For example, one of the stated objects of the Peters apparatus is to produce a large number of filled straws during a given operating period. It requires a fairly large supply of liquid and straws to operate, appears to be fairly complex to assemble, operate, and clean, and therefore cannot be easily or efficiently used to produce a small batch of filled straws. This is a serious drawback for a small honey producer, who is unlikely to have a large batch of honey available for processing at any given time. The result is that the honey producer must choose between storing small batches of honey until sufficient is obtained to produce a large batch of straws at once, aggregating the producer's own honey with honey produced by others, or not having the popular and profitable honey straw product available. Further, the apparatus of Peters appears to be too large, heavy, and complex for easy portability, and does not appear to be easily adaptable for different sizes of product. It also has not been made commercially available, perhaps at least in part because of its complexity and likely prohibitive cost.

What has been needed, therefore, is a device for filling straws with liquids that is relatively small and lightweight, portable, simple to operate, low cost, low maintenance, commercially producible on a reasonably large scale, capable of efficiently processing small batches of product without waste, and easily adaptable for producing different types and sizes of product.

OBJECTS OF THE INVENTION

Accordingly, an object of the present invention is to provide a device for filling straws with liquid that may be effectively and efficiently utilized for processing small amounts of product.

Particular objects of the invention are to provide a straw-filling device that is small, lightweight, and portable.

Further particular objects of the present invention are to provide a straw-filling device that is low cost to produce and purchase, and is cost-effective to operate.

Other particular objects of the invention are to provide a straw-filling device that is simple to assemble, operate, and maintain.

Yet another particular object of the invention is to provide a straw-filling device that is easily adaptable for producing different types and sizes of product.

SUMMARY

These and other objectives are met by the present invention, which is an automated, fully programmable, adaptable device for filling straws or straw-like receptacles with any type of flowing, or flowable, liquid. In an embodiment of the present invention, a straw or straw-like receptacle is dropped from a hopper down one or more chutes into a capture area where it is held and filled with liquid, after which it is sealed and released. The straw dropping, capture, filling, and sealing actions are preferably automatically controlled via a preprogrammed electronic sequence. The major elements of a typical embodiment of the invention include means for dropping a straw or other receptacle into a fixed mounting position consistently, optional means for heating fluids throughout the fill process, means for filling the receptacle, and means for sealing the receptacle. Preferably, all steps are controlled with an adaptable, programmable electronic controller and are monitored by one or more sensors.

In one embodiment, the straw hopper has a retractable slide plate at its base for holding back the straws, sliding back to allow only one straw at a time to fall through the chutes into the capture area. The straw preferably drops from the hopper and through the chutes solely under the impetus of gravity. The dropping of a straw consistently into the capture area is an important aspect of the present invention.

In one embodiment of the present invention, after falling through the chutes, the straw comes to rest in the capture area, where it is pinched and sealed at the bottom in preparation for filling. A filling nozzle moves into a predefined position over the straw and the straw is filled with a preset amount of liquid. After filling, the top of the straw is pinched and then sealed, completing packaging of the liquid. The preferred embodiment of the present invention has a fully automatic programmed sequence of pinch, seal, fill, and then pinch and seal again. After sealing, the straw is dropped into the collection area. Preferably, the sequence of actions may be easily adapted or changed by reprogramming the automatic controller.

DETAILED DESCRIPTION

Figure 1:
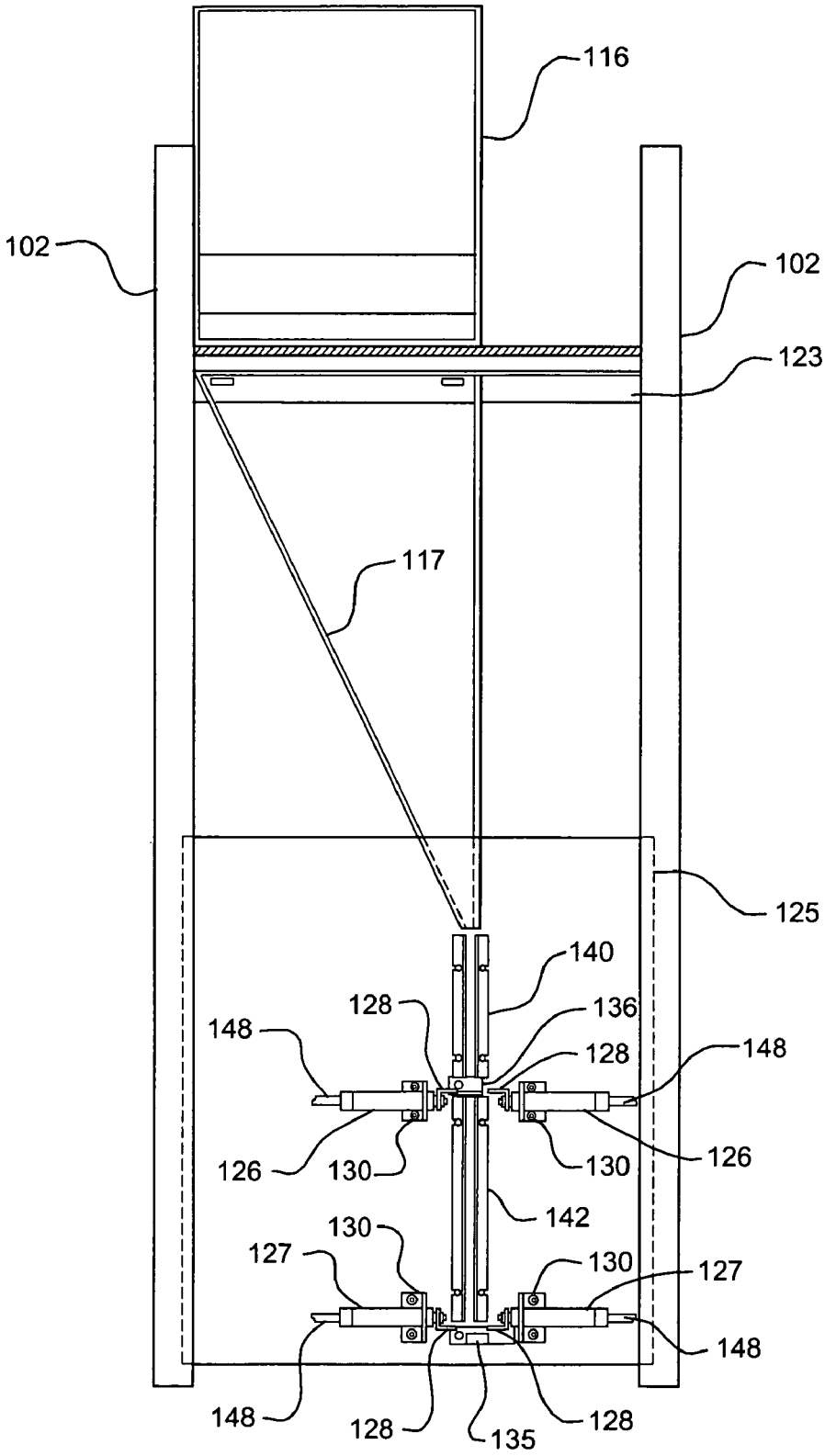
FIG. 1 is a front view of a full device assembly according to an embodiment of the present invention.

The present invention is an automated, fully programmable, and adaptable device for filling straws or straw-like receptacles with any type of flowing, or flowable, liquid. The device of the present invention is portable, affordable, and highly adjustable. The present invention may be effectively utilized in many industries including, but not limited to, beekeeping (honey producing), maple syrup producing, coffee/tea, candy/food, medical, and industrial.

In an embodiment of the present invention, a straw or straw-like package is dropped from a hopper down one or more chutes into a capture area. The straw is then captured, held, and filled with a free flowing liquid, after which it is sealed. The straw dropping, capture, filling, and sealing actions are preferably automatically controlled via a preprogrammed electric sequence. The device also preferably automatically warms the fill liquid and switches itself off when the fill liquid is gone or the straw hopper is empty. The major elements of a typical embodiment of the invention include means for dropping a straw or other receptacle into a fixed mounting position consistently, optional means for heating fluids throughout the fill process, means for filling the receptacle, and means for sealing the receptacle.

The device of the present invention may be advantageously utilized to fill any straw or straw-like package. The packages may be presealed at the bottom, or may be sealed during the filling process. While any type of straw or other receptacle may be used, plastic straws are particularly suitable, being sturdy and easily sealable by heating. In a prototype embodiment, a standard plastic 7¾" long straw capable of holding 4 ml of liquid has been advantageously employed. Alternate embodiments advantageously employ biodegradable straws and edible-type straws comprised of materials that dissolve slowly in very hot liquids (such as coffee or tea).

Using the present invention, straws or straw-like receptacles may be filled with any liquid that flows freely into the fill orifice (typically, a ¼ inch diameter orifice, but any size suitable for the chosen liquid and straw size may be used). If desired, or needed to create the desired flow rate, a heater or heaters located on the flow gate, injector, and/or in the pail of liquid may be used to insure that the chosen liquid is free flowing during filling. This aspect is particularly useful when the chosen liquid has a high viscosity, such as honey, maple syrup, or cough syrup.

In one embodiment, the straw hopper has a retractable slide plate at its base for holding back the straws, sliding back to allow only one straw at a time to fall through the chutes over a tip bolt and into the capture area. The straw preferably drops from the hopper and through the chutes solely under the impetus of gravity, although various impelling mechanisms known in the art may also be employed. The dropping of a straw consistently into the capture area is an important aspect of the present invention.

In one embodiment of the present invention, after falling through one or more chutes, the straw comes to rest in the capture area, where it is held and then pinched and sealed at the bottom in preparation for filling. After filling, the top of the straw is pinched and then sealed, completing packaging of the liquid. The preferred embodiment of the present invention has a fully automatic programmed sequence of pinch, seal, fill, and then pinch and seal again. In one embodiment, this automatic sequence is achieved by utilizing a fully programmable electronic controller and a pneumatic system that controls the entire series of sequences down to milliseconds. Preferably, the sequence of actions may be easily adapted or changed by reprogramming the automatic controller.

In one embodiment, the straws are filled by a long narrow fill nozzle moved consistently into position over them. The straw is then sealed by any suitable method known in the art. In a typical embodiment, the straw is sealed by heat, such as that produced by a wire that has a small current going through it or by a heater wand passed over the pinched straw end. After sealing, the straw is then dropped into the collection area, typically being collected into a box or bucket.

In the preferred embodiment, the slide plate at the bottom of the hopper moves back and forth in a predefined fully programmable sequence. The straw then drops down the chute or chutes designed to achieve exact straw placement. The hopper and chutes are preferably acrylic, although any material suitable for use in food processing applications may be used. If the straw or other package has not yet been sealed at the bottom, it is sealed at the bottom before filling. Next, the filling sequence commences, followed by the top sealing process, all as presequenced at the controller. In one embodiment, a filling nozzle moves into a predefined position over the straw to be filled and the straw is filled with a preset amount of liquid. The straw is then sealed. From there, it drops out into a collection area that may be individually designated. Preferably, all steps are controlled with an adaptable, programmable electronic controller and are monitored by one or more sensors, preferably with one sensor monitoring each phase of operation, thereby ensuring consistent safety and efficiency.

FIG. 1 shows the front view of the full device assembly of a preferred embodiment of the present invention. As seen in FIG. 1, the device is mounted in frame 102. The frame is preferably high tensile extruded aluminum, but any suitably durable and preferably lightweight material may be used. An optional removable cover panel (not shown, preferably acrylic), is mounted to device frame 102 on the inside by two bolts attached in channels in frame 102. Hopper 116, and chute 117 with adjustable slide mounting bar 123, are aligned above front piston plate 125. Upper 126 and lower 127 sets of pistons are mounted by piston mounting brackets 130 on the front of front piston plate 125, as are piston pinch feet 128, the fill mechanism assembly (not shown; depicted in FIG. 8), lower stop/seal block 135, and top seal block 136. Included on front piston plate 125 are top 140 and bottom 142 straw alignment guide brackets. Also shown are piston hoses 148. In particular, this view depicts the alignment of all components involved in the drop, pinch, fill, and seal sequences.

Figure 2:
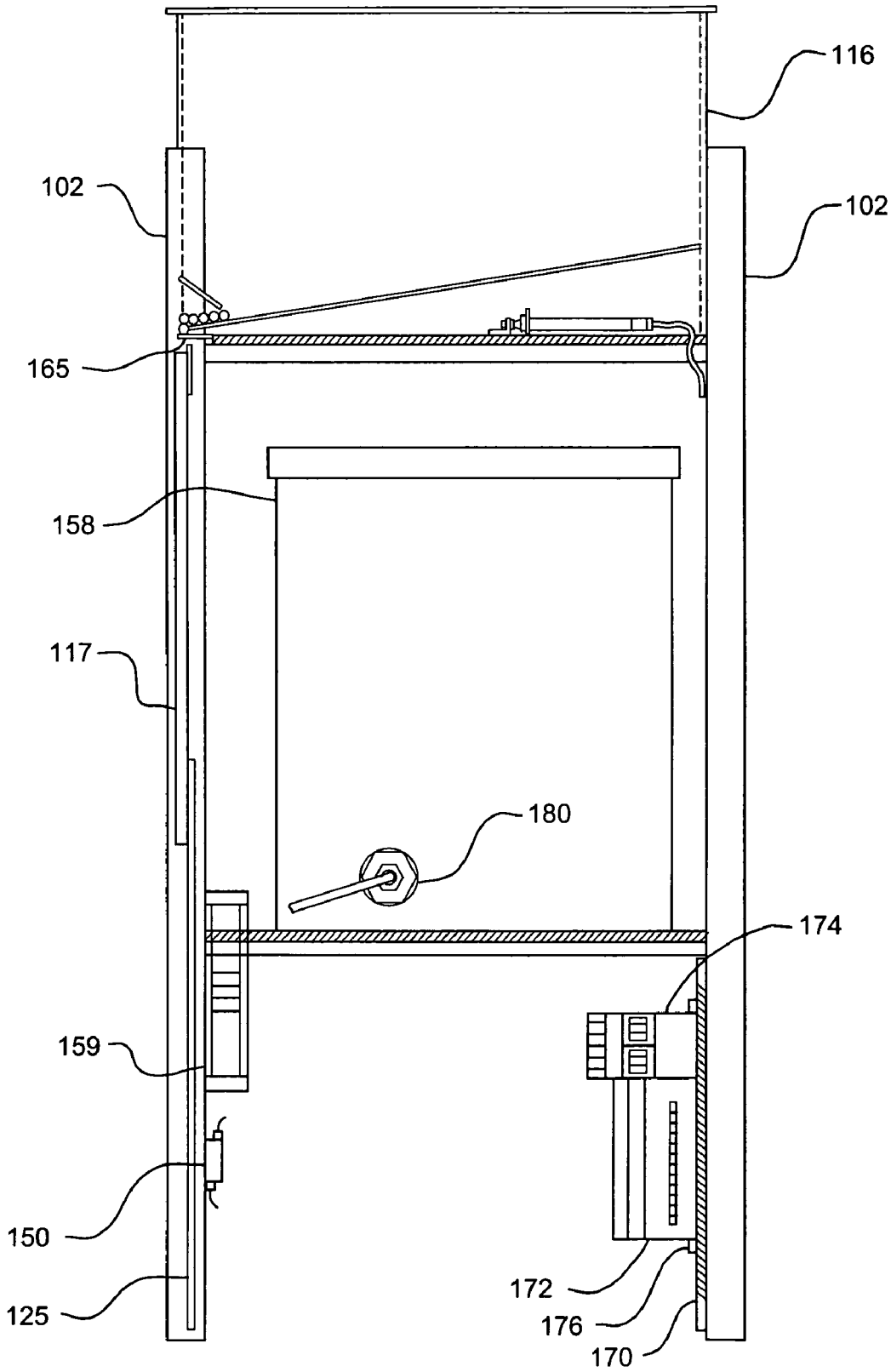
FIG. 2 is a side view of a full device assembly of the embodiment of FIG. 1.

FIG. 2 shows the side view of the full device assembly of the embodiment of FIG. 1. Hopper 116 is located on the top of frame 102. Chute 117 is mounted directly below hopper 116, toward the front of the device. Chute 117 is aligned with upper and lower straw guide brackets 140, 142 for proper straw alignment. A dropped straw follows straw alignment guides 140, 142 all the way to lower stop and seal bracket 135. The straw is drawn and held through a hole on front plate 125 by venturi 150 located on the back surface of front plate 125. Also shown are supply pail 158 and liquid injector 159. Straw slide 165 allows dispensing of one straw at a time from hopper 116 into chute 117. Electrical mounting plate 170 holds programmable electric controller 172 and power supply 174 by way of mounting bar 176. Also shown is pail locating and flow regulating assembly 180, depicted in detail in FIG. 9.

Figure 3:
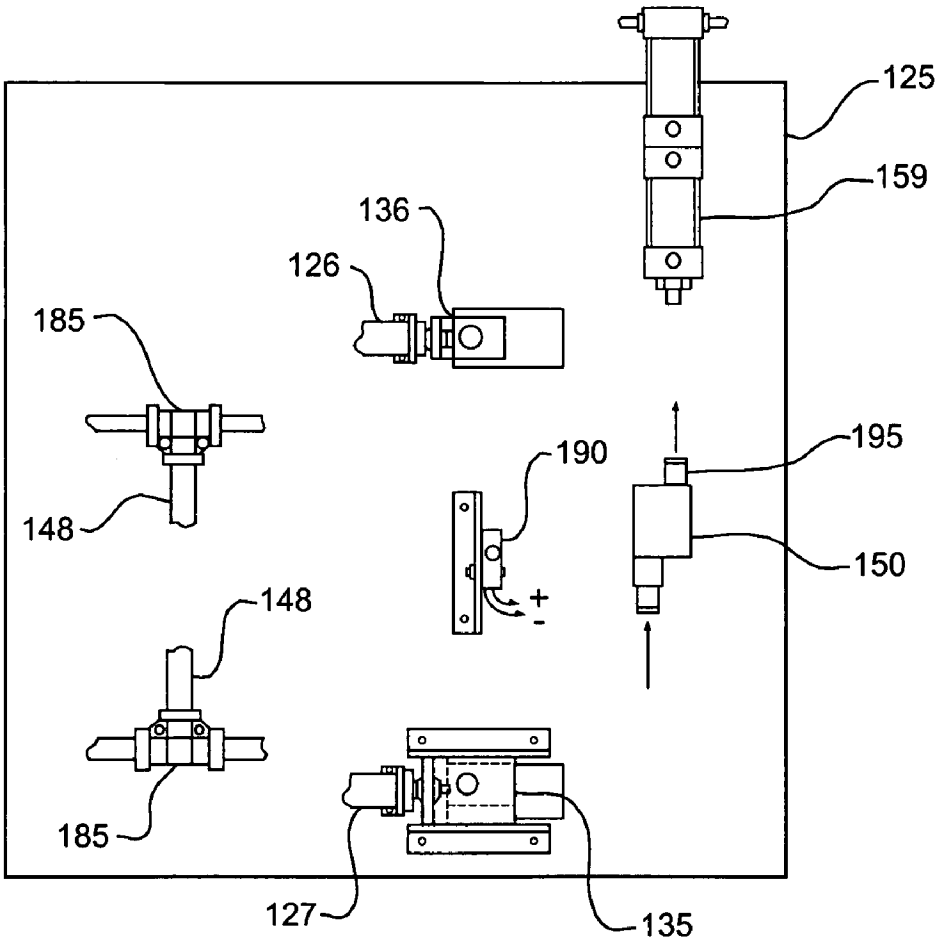
FIG. 3 is a full assembly view of the rear of a front panel of the embodiment of FIGS. 1 and 2.

FIG. 3 is a full assembly rear view of the components located on front piston panel 125 of the embodiment of FIGS. 1 and 2. Shown are upper seal block 136, lower stop and seal block 135, upper and lower pistons 126, 127, and two microlok "tee" fittings 185. These components are connected by piston tubing 148. Also shown is venturi 150. Liquid injector 159 has check valves and is optionally wrapped by an injector heater band. Visible half way down piston plate 125 is optional sealing sensor 190, mounted to an inside bar.

Figure 4:
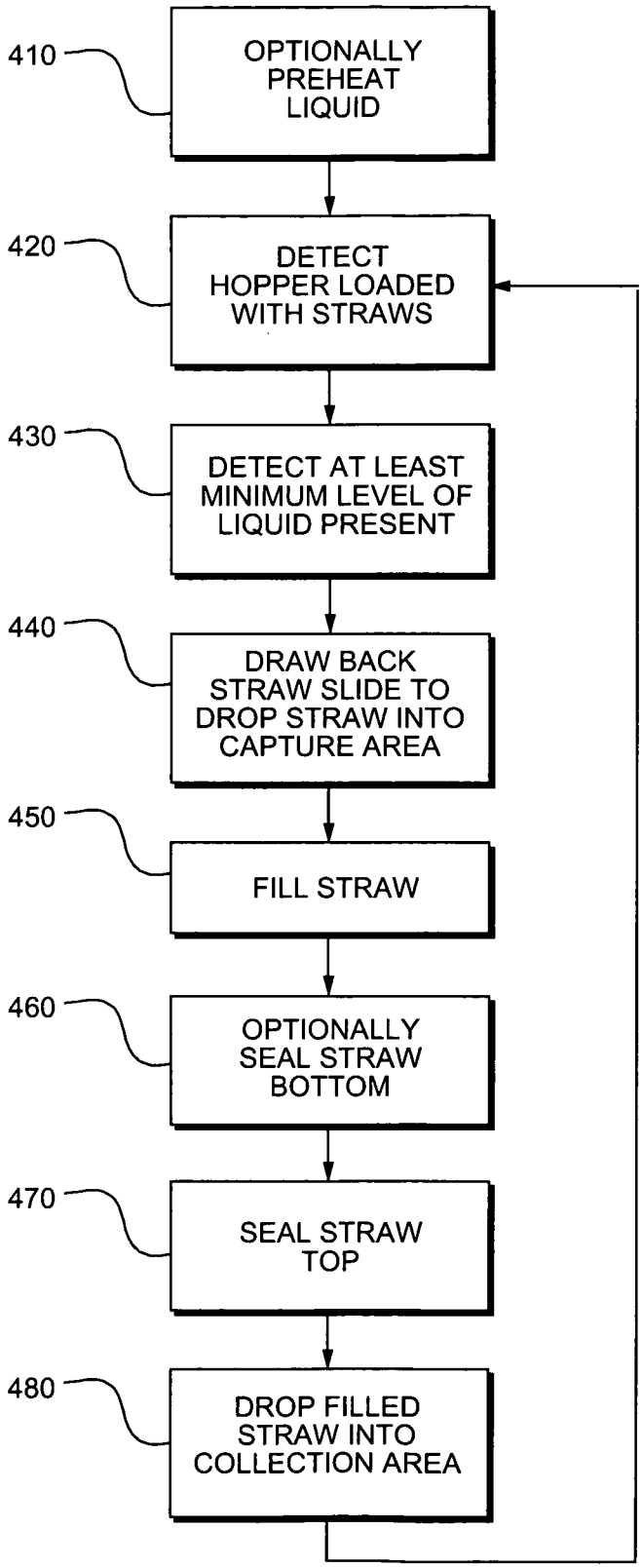
FIG. 4 illustrates the basic operation of an embodiment of a device according to the present invention.

FIG. 4 illustrates the basic operation of an embodiment of a device according to the present invention. As shown in FIG. 4, the liquid is first optionally preheated 410. The device checks to make sure that the hopper is loaded with straws 420 and that at least the minimum required operational level of liquid is present 430. The straw slide is drawn back 440 so that a straw may drop into the capture area. The straw is then filled 450. If the straw bottom is not presealed, the bottom is sealed 460 at this time. The top is then sealed 470, and the filled and sealed straw is dropped 480 into the collection area before the sequence begins again.

Figure 5:
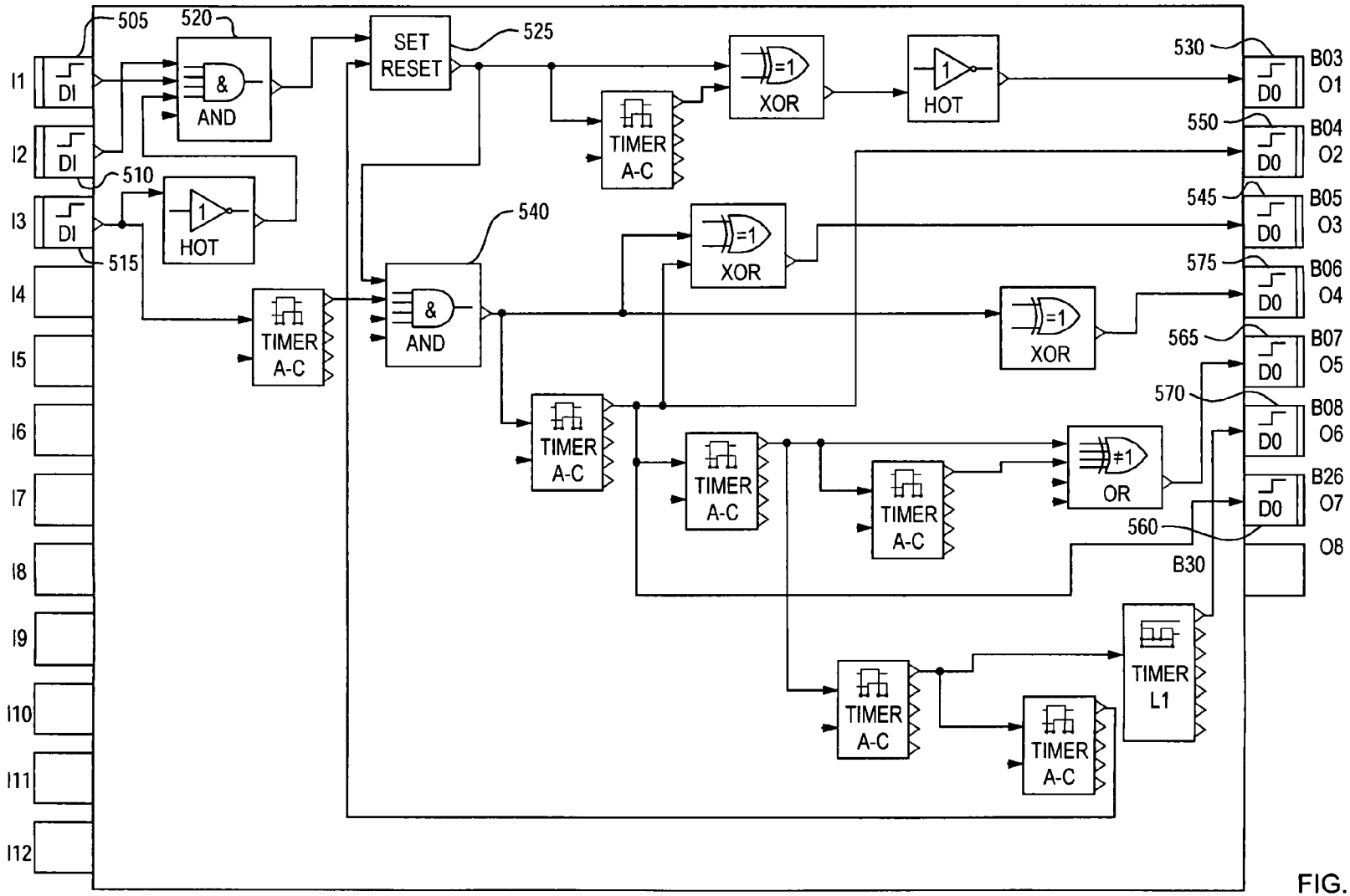
FIG. 5 is an electrical flow diagram for a device according to an embodiment of the present invention.

FIG. 5 is an electronic flow diagram of a preferred embodiment of the present invention. As shown in FIG. 5, inputs 505, 510, 515 from the three sensors, the straw drop sensor that detects whether there are straws in the hopper, the liquid level sensor, and the straw in/out (sealing) sensor 190 that detects whether or not there is a straw in the capture area, are used by programmable electronic controller 172 to control the device sequence. When all inputs are high 520, indicating that there are straws in the hopper, the liquid level is above the minimum, and there is no straw in the capture area (the low signal from sensor 190 being inverted), the sequence is initiated 525 by triggering 530 pull back of the top slide in order to release a straw into the capture area. Straw in/out sensor 190 then goes high, indicating 540 that a straw is in place in the capture area and triggering the fill sequence. In this embodiment, the fill sequence begins with a bottom pinch 545, followed by a bottom seal 550. Next, the straw is filled 560, initiating pinching 565, and then sealing 570, of the top of the straw. Finally, the straw is released 575 into the collection area and the sequence is reset 525.

Figure 6:
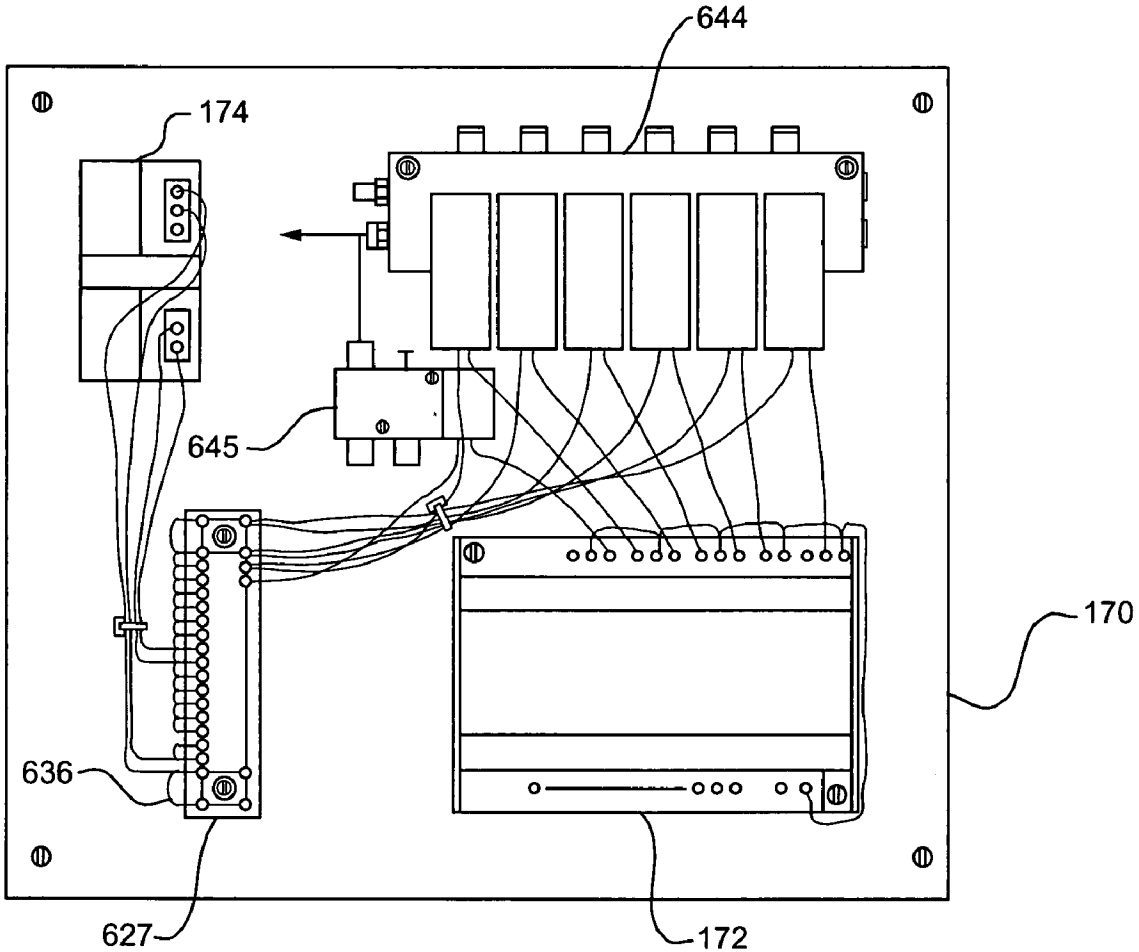
FIG. 6 is an electrical and pneumatic assembly for a device according to an embodiment of the present invention.

FIG. 6 depicts the electrical and pneumatic assembly panel of a preferred embodiment of the present invention. This assembly includes electrical mounting plate 170 and fully programmable electronic controller 172, which is mounted with power supply 174 by mounting bar 176 (shown in FIG. 2). Also shown are electrical terminal bar 627 with wire 636, valve manifold combo 644, and 4-way injector valve 645. All wiring is preferably secured with common cable tie brackets.

Figure 7:
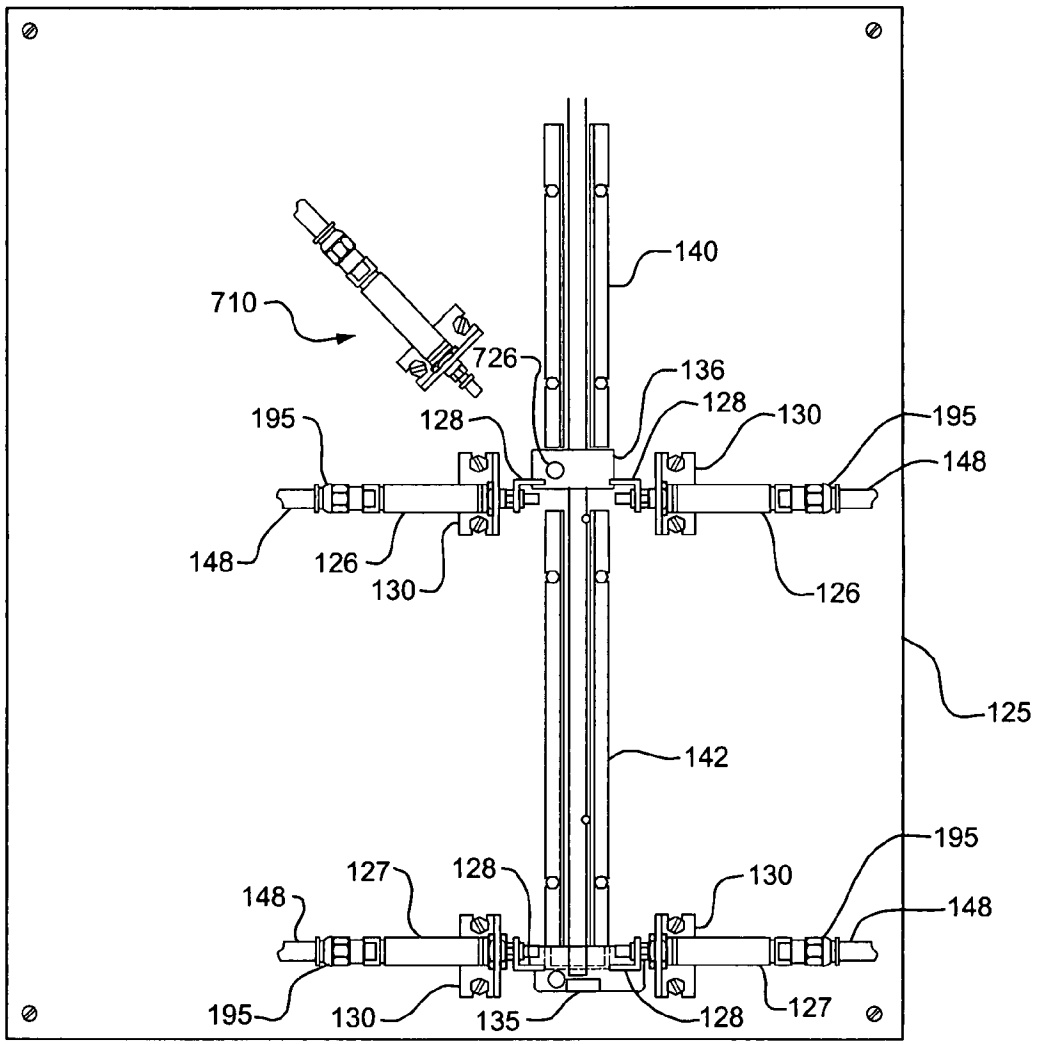
FIG. 7 is a detailed view of a front piston plate assembly for use in a device according to an embodiment of the present invention.

FIG. 7 depicts the front piston plate assembly of a preferred embodiment of the present invention. This assembly includes front piston mounting plate 125, two sets of pistons 126, 127, pinch feet 128, piston mounting brackets 130, and piston tubing 148. Also shown are fill nozzle assembly 710 (detail in FIG. 8) and upper and lower seal blocks 136, 135. Straw guide brackets 140, 142 are positioned in line with straw chute 117 (shown FIG. 1). Upper straw guide bracket 140 is positioned closely below straw chute 117 and terminates just above top pinch feet 128. Lower straw guide bracket 142 is positioned directly in line with upper straw guide 140, insuring proper straw alignment for the stop, pinch, fill, and seal sequencing. Piston tubing fittings 195 are shown attached to piston tubing 148 and heater element 726 is positioned at upper seal block 136.

Figure 8:
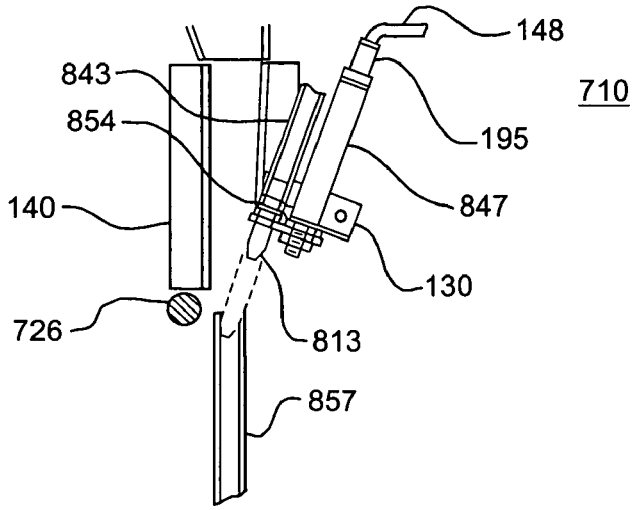
FIG. 8 is a detailed view of a fill apparatus for use in a device according to an embodiment of the present invention.

FIG. 8 is a detailed view of the fill apparatus of a preferred embodiment of the present invention. Shown are fill nozzle assembly 710 and its alignment to straw 857 when straw 857 is held by venturi 150 (FIG. 2) in guide bracket 142 (shown in FIG. 7). The components are pistons 126, 127 (FIG. 7), mounting brackets 130, and pinch feet 128 (FIG. 7). Fittings 195 are attached to piston tubing 148. To allow filling straw 857, silicone tubing 843 is attached at one end to fill nozzle 813 by pinch clamp 854 and at the other end to liquid injector 159 (FIG. 2). Also shown are heater element 726, upper straw guide 140, and fill apparatus piston 847. In one embodiment, the liquid flow is maintained by use of a band heater mounted to the liquid cavity end of injector 159. Heater cartridges 726, typically 0.25" diameter, are wired so as to provide consistent heat for sealing the ends of straw 857.

Figure 9:
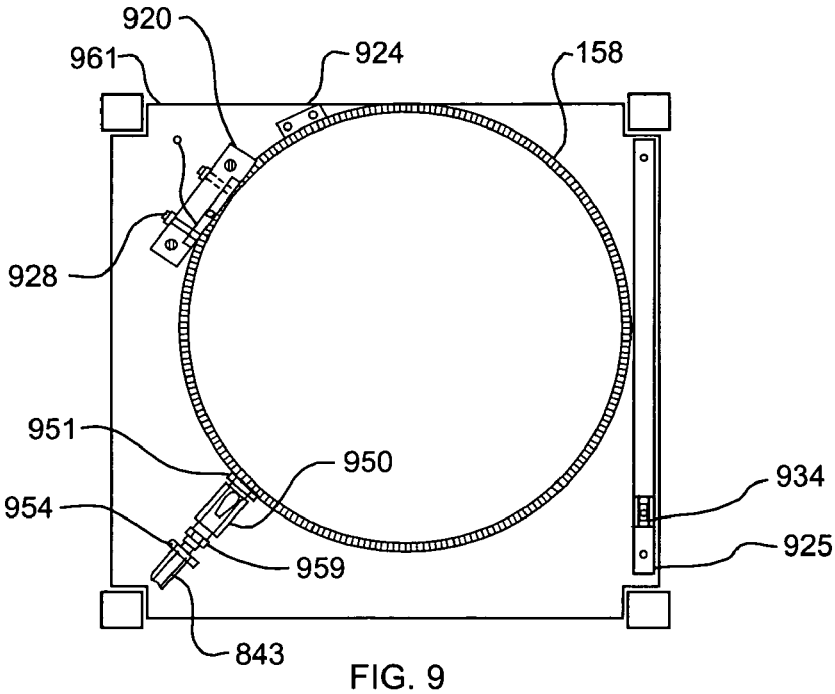
FIG. 9 is a detailed view of a pail locating and a flow regulating apparatus for use in a device according to an embodiment of the present invention.

FIG. 9 is a detailed view of the pail locating and flow regulating apparatus of a preferred embodiment of the present invention. The pail positioning and flow control assembly includes two pail locating blocks 920, 924. Block 920 has optional liquid level sensor 928 attached to it. Another block 925 has sequencing toggle 934 attached. Also shown are flow regulator 950, pail bulkhead and o-ring with nut (mounting chuck) 951, and silicone tubing 843, attached by spring clip 954 to brass barb 959. All components are attached to pail floor plate 961 or supply pail 158.

Figure 10:
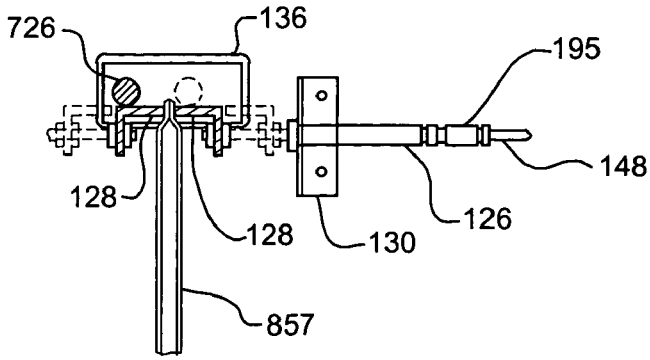
FIG. 10 is a detailed view of a pinch and seal apparatus for use in a device according to an embodiment of the present invention.

FIG. 10 is a detailed view of a pinch and seal apparatus for use in a preferred embodiment of the present invention. Shown is the fill nozzle assembly 710 and its alignment to straw 857 when straw 857 is held in guide brackets 142 (FIG. 7) by venturi 150 (FIG. 2). The components shown are upper pistons 126, mounting brackets 130, and pinch feet 128. Attached are fittings 195 for piston tubing 148.

With reference to the embodiments and diagrams of FIGS. 1–10, the portable straw-filling machine with its fully adjustable frame 102 provides unlimited flexibility for upgrades, adaptations, and interchangeability of parts. Mounted to frame 102 are optional exterior panels, which are preferably durable and easily cleaned. Inside the machine center cavity are supply pail 158, mounting chuck 951, and flow regulator 950. Flow regulator 950 controls the flow of liquid through silicone tubing 843 to one end of injector 159, which is preferably adjustable to accommodate a wide variety of flowing fluids. During filling, liquid flows out through the other end of injector 159 and then through silicone tubing 843 to fill nozzle 813.

To initiate straw filling, straw hopper 116 is filled with straws 857. Although a regular plastic straw 857 is depicted, biodegradable and/or edible straws are also suitable. The straw hopper sensor completes the sequencing circuit when straws 857 are sensed in hopper 116, allowing the fully programmable electronic controller 172 to start. The programmability of controller 172 provides the present invention with the ability to utilize many different timing sequences and/or additional components. Optional heater elements 826 may initially be preheated, which may be accomplished by a switch or, if preferred, by simple plugging in of the device power cord. After the warm up time, toggle switch 934 is turned on in order to enable sequencing to begin. First, toggle switch 934 initiates priming of fill assembly 710 and clean cycling of injector 159, preparing the device to begin fill operations. The sequencing then starts, providing that all three sensors have met their requirements: the straw sensor must detect straws 857 in straw hopper 116, liquid sensor 928 must detect a minimum level of liquid in supply pail 158, and sealing sensor 190 must not detect a straw in the capture area.

When fully programmable electronic controller 172 begins the sequence, straw slide 165 draws back, and using gravity, a straw drops from straw hopper 116, through adjustable straw chute 117. The straw preferably drops over a tip bolt, ensuring a straight drop down along independently adjustable upper and lower straw guide brackets 140, 142, which can be adjusted to accommodate straws with a wide variety of diameters and lengths. As straw 857 drops, it comes to rest on lower stop/seal block 135 and is drawn and held by venturi 150.

Lower pinch feet 128 are then activated and close along the bottom lower edge of the straw 857, holding it securely. The fill nozzle sequence moves nozzle 813 into position to fill straw 857 at the same time that the low pinch occurs. The adjustable programmed time fill sequence begins. Lower heater 135 then seals the lower end of straw 857 before the fill sequence ends. When the fill sequence ends, fill nozzle 813 retracts back out of the way to allow top pinch feet 128 to close on the top end of straw 857. Top heater 136 then seals the top end of straw 857. As the seal sequence finishes, straw 857 drops out of the capture area, into any collection receptacle positioned below. Once straw 857 has cleared the capture area, sealing sensor 190 verifies that the slot is empty and the sequence begins again.

An example of the preferred embodiment of the present invention is the Original Bench Top "Sticky Machine™", available from Busy Bee Farm, 140 Langford Rd, Raymond, N.H. 03077, USA, http://www.busybeefarm.com. This embodiment is portable, standing 36" H×14" W×16" L and weighing less than 50 pounds. The machine runs with the electronic power controller at 24v 115 DC. A micro air compressor is used to power the hydraulic air solenoids and pistons. 50-Watt cartridge heaters are used for the sealing process. All the components are powered and controlled by the controller at 24V DC and 115 W. The machine plugs into a standard 110V wall outlet and is rated for use from 54–225 degrees Fahrenheit. The process components meet USDA and FDA regulations for purity.

In the Sticky Machine™, all food process exposed components have high ratings for temperature, acidic levels, and neutral bases. The machine uses a custom injector for dispensing high acidity fluids or neutral Ph fluids. Mounting positioning for components is highly adaptable and all plates are mounted on slots for a greater degree of mounting flexibility. Using standard commercially-available parts throughout the device, the Sticky Machine™ requires only simple mechanical assembly that is well within the ability of typical consumers. The Sticky Machine™ provides high production capabilities and adjustable flow volume to accommodate different fluids and receptacle sizes. The frame is extruded aluminum with channels for securely mounting an interchangeable color acrylic exterior skin. The machine dispenses approximately 2500 straws from an acrylic hopper. A clear hopper side allows visual checking of straw level by the operator. All procedures are controlled by an adaptable, pre-programmed electronic controller. Three sensor monitors, each monitoring one of three phases of operation, ensure consistent safety and efficiency. One- and five-gallon pail models are available.

The preferred embodiment of the device of the present invention has provisions for accepting additional components and upgrades. One useful add-on is a labeler, which allows labeling of the filled straws with product or producer information such as farm name and address, honey type and/or grade, packaging date, etc. In one embodiment, the labeler includes a collector chute mounted below the drop out chutes. A mechanized conveyor at the bottom of the collector chute then collects and nestles the straw, moving it to a rubberized round disk embossed with the desired labeling characters. As the filled straw passes along side the rotating disk, the characters of the label are printed by disposal of the ink along one side of the straw. The ink used is preferably of a food digestible type.

The process components used to implement the present invention are preferably food-grade and/or rated for use with the various possible liquids. Examples of suitable liquids include, but are not limited to, honey, maple syrup, medicines such as cough syrups, liquors, coffee flavoring syrups, tea flavorings, oils, and liquid soaps. Some of the suitable applications of the present invention include production of honey straws, maple syrup straws, and single-dose cough syrup packaging, as well as commercial applications using liquid products. An example of the latter is packaging of flavorings, such as vanilla extract, in order to provide exact, consistent amounts of flavorings for cooking applications. Other suitable applications of the device of the present invention include packaging of oils, such as lubricating oils, and single-use liquid soaps.

The present invention, therefore, is an automated, fully programmable, and adaptable device for filling straws or straw-like receptacles with any type of flowing, or flowable, liquid. This device may be effectively and efficiently utilized in processing small amounts of product, is small, lightweight, and portable, is low cost to produce and purchase, is cost-effective to operate, is simple to assemble, operate, and maintain, and is easily adaptable for producing different types and sizes of product. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Other arrangements, methods, modifications, and substitutions by one of ordinary skill in the art are therefore also considered to be within the scope of the present invention, which is not to be limited except by the claims that follow.

What is claimed is:

1. A receptacle-filling device comprising, in combination:

receptacle supply container;

at least one contiguously connected receptacle guide;

receptacle dispenser connected between the receptacle supply container and the top of the contiguously connected receptacle guide;

receptacle capture and positioning device adapted for holding a single receptacle at a time, the receptacle capture and positioning device being positioned at the bottom of the contiguously connected receptacle guide, the receptacle capture and positioning device remaining in a stationary position with respect to the receptacle guide and the receptacle dispenser when the device is operating, the receptacle capture and positioning device retaining the single receptacle in a stationary position with respect to the receptacle guide and the receptacle dispenser from the time the receptacle is captured until the time the receptacle has been filled;

liquid supply container;

liquid dispenser for filling the receptacle being held in the receptacle capture and positioning device, the liquid dispenser being connected to the liquid supply container and moveably positionable over the opening of the receptacle being held in the receptacle capture and positioning device; and at least one receptacle sealer for sealing the receptacle after filling.

2. The device of claim 1, further including at least one electronic controller for controlling at least one of the receptacle dispenser, the receptacle capture and positioning device, the liquid dispenser, and the receptacle sealer.

3. The device of claim 2, wherein the electronic controller is programmable.

4. The device of claim 2, further including at least one sensor.

5. The device of claim 4, wherein at least one sensor detects the presence of receptacles in the receptacle supply container.

6. The device of claim 4, wherein at least one sensor detects the presence of liquid in the liquid supply container.

7. The device of claim 4, wherein at least one sensor detects the presence of a receptacle in the receptacle capture and posistioning device.

8. The device of claim 1, further comprising at least one liquid heater.

9. The device of claim 1, further including at least one receptacle pincher.

10. The device of claim 1, further including a receptacle collector.

11. The device of claim 1, wherein the receptacle supply container is a hopper.

12. The device of claim 1, wherein the receptacle sealer employs heat.

13. The device of claim 1, wherein the receptacle dispenser is a sliding plate over an opening to the top of the contiguously connected receptacle guide.

14. A device for filling straws with liquid comprising, in combination:

straw hopper;

straw chute;

straw dispenser connected between the straw hopper and the top of the straw chute;

at least one contiguously connected straw guide connected to the bottom of the straw chute;

straw capture device for holding a single straw at a time in a fixed position, the straw capture device being positioned at the bottom of the contiguously connected straw guide, the straw capture device remaining in a stationary position with respect to the straw guide and the straw dispenser when the device is operating, the straw capture device retaining the single straw in a single, stationary position with respect to the straw guide and the straw dispenser from the time the straw is captured until the time the straw has been filled;

liquid supply container;

liquid dispenser connected to the liquid supply container, the liquid dispenser being moveably positionable over the opening of a straw being held in the straw capture device;

at least one straw pincher;

at least one straw sealer for sealing the straw after filling;

electronic controller;

sensor for detecting the presence of straws in the hopper;

sensor for detecting the presence of liquid in the liquid supply container; and sensor for detecting the presence of a straw in the straw capture device.

15. The device of claim 14, wherein the electronic controller is programmable.

16. The device of claim 14, further comprising at least one liquid heater.

17. The device of claim 14, wherein the straw dispenser comprises a sliding plate over an opening to the top of the straw chute.

18. A method of making liquid-filled receptacles comprising, in combination, the steps of:

dropping a receptacle from a supply container into a receptacle capture device;

capturing the receptacle in a fixed mounting position in the receptacle capture device;

filling the receptacle with liquid while the receptacle is held in the fixed mounting position in the receptacle capture device;

sealing the filled receptacle while the receptacle is held in the fixed mounting position in the receptacle capture device;

maintaining the receptacle in a single, stationary position with respect to the supply container throughout the steps of capturing, filling, and sealing;

maintaining the receptacle capture device in a single stationary position with respect to the supply container throughout the steps of dropping, capturing, filling, and sealing; and releasing the filled and sealed receptacle from the fixed mounting position.

19. The method of claim 18, further comprising the step of sealing the bottom of the receptacle before filling.

20. The method of claim 18, further comprising the step of heating the liquid before filling.

21. The method of claim 18, further comprising the step of pinching the receptacle before sealing.

22. The method of claim 21, wherein the step of sealing employs heat.

23. The method of claim 18, further comprising the step of collecting the released filled receptacles.

24. The method of claim 18, wherein the steps are controlled by a preprogrammed sequence.

25. The method of claim 24, further including the step of sensing the presence of receptacles in the supply container.

26. The method of claim 24, further including the step of sensing the presence of liquid in a liquid supply container.

27. The method of claim 24, further including the step of sensing the presence of a receptacle in the fixed mounting position in the receptacle capture device.

28. The method of claim 18, wherein the step of dropping relies on gravity for correctly positioning the receptacle in the fixed mounting position of the receptacle capture device.

29. A method of making liquid-filled straws comprising, in combination, the steps of:

sensing the presence of at least one straw in a straw hopper;

sensing the presence of at least a minimum level of liquid in a liquid supply container;

sensing the absence of a straw in a mounting device;

dropping a straw from the straw hopper through at least one chute into the mounting device;

capturing the straw in the fixed mounting device;

filling the straw with liquid from the liquid supply container while the receptacle is held in the fixed mounting device;

sealing the filled straw while the receptacle is held in the fixed mounting device;

maintaining the straw in a single, stationary position with respect to the straw hopper and the liquid supply container throughout the steps of capturing, filling, and sealing;

maintaining the fixed mounting device in a stationary position with respect to the straw hopper and the liquid supply container throughout the steps of dropping, capturing, filling, and sealing; and releasing the filled straw from the mounting device.

30. The method of claim 29, wherein the steps are controlled by a programmable electronic controller.

31. The method of claim 29, further comprising the step of sealing the bottom of the straw before filling.

32. The method of claim 29, further comprising the step of heating the liquid before filling.

* * * * *